US010843327B2

(12) United States Patent
Etzinger

(10) Patent No.: US 10,843,327 B2
(45) Date of Patent: Nov. 24, 2020

(54) STOWABLE WORK BENCH FOR A TOOL CHEST

(71) Applicant: Centrex Plastics, LLC, Findlay, OH (US)

(72) Inventor: William Etzinger, Fostoria, OH (US)

(73) Assignee: CENTREX, LLC, Sycamore, OH (US)

( * ) Notice: Subject to any disclaimer, the term of this patent is extended or adjusted under 35 U.S.C. 154(b) by 635 days.

(21) Appl. No.: 15/590,125

(22) Filed: May 9, 2017

(65) Prior Publication Data

US 2018/0326572 A1 Nov. 15, 2018

(51) Int. Cl.

| | |
|---|---|
| ***B25H 1/04*** | (2006.01) |
| ***B25H 1/12*** | (2006.01) |
| ***B25H 3/02*** | (2006.01) |
| *A47B 3/10* | (2006.01) |

(52) U.S. Cl.

CPC ..... *B25H 1/04* (2013.01); *B25H 1/12* (2013.01); *B25H 3/02* (2013.01); *A47B 3/10* (2013.01)

(58) Field of Classification Search

CPC ... B25H 1/00; B25H 1/04; B25H 1/12; B25H 1/16; B25H 1/18; B25H 3/02; B25H 3/023; B25H 3/028; B25H 3/027; B25H 3/026; B62B 1/006; B62B 1/10

USPC ..... 269/17, 16; 29/281.1

See application file for complete search history.

(56) References Cited

U.S. PATENT DOCUMENTS

| | | | | |
|---|---|---|---|---|
| 2,829,863 A * | 4/1958 | Gibson | B66F 7/065 254/8 C |
| 5,224,531 A | 7/1993 | Blohm | |
| 6,113,202 A | 9/2000 | Germano | |
| 8,584,601 B1 * | 11/2013 | Deschner | B25H 1/04 108/135 |
| 2017/0129097 A1 * | 5/2017 | Engvall | B25H 1/04 |

* cited by examiner

*Primary Examiner* — Tyrone V Hall, Jr.
*Assistant Examiner* — Abbie E Quann
(74) *Attorney, Agent, or Firm* — Jacob M. Ward; Ward Law Office LLC

(57) ABSTRACT

A stowable work bench is configured to be stowed in a tool chest. The stowable work bench has a platform with a first sidewall and a second sidewall. A work surface is disposed between the first sidewall and the second sidewall. The platform is coupled to a first set of legs, which are connected to the first sidewall of the platform, and a second set of legs, which are connected to the second sidewall of the platform. The first set of legs are also attached to a first elongate base support that is spaced apart from the platform. The second set of legs are also attached to a second elongate base support that is spaced apart from the platform. In operation, the first set of legs and the second set of legs are configured to collapse and expand to adjust a distance between the platform and the elongate base supports.

13 Claims, 10 Drawing Sheets

STOWABLE WORK BENCH FOR A TOOL CHEST

FIELD

The disclosure generally relates to a work bench and, more specifically, to a collapsible work bench stowed within a tool chest.

BACKGROUND

Setting up a construction site can prove difficult. Workers frequently must carry their tools on site using a tool chest, toolbox or similar tote. Once on site, workers often need to create a separate surface to lay out their tools and other materials. These separate work surfaces can be a hassle to assemble, taking time away from the task at hand.

Portable tool boxes that are equipped with a work surface are well known in the art. For example, U.S. Pat. No. 5,224,531 to Erich Blohm teaches a portable apparatus for storing tools in an organized fashion, and which also converts to a combination saw table, router table and work bench. The apparatus can be readily maneuvered, loaded into a truck bed and stored when folded. Additionally, the U.S. Pat. No. 6,113,202 to Charles A. Germano relates to a tool box-supply cabinet and work bench combination and, more particularly, a portable, wall-mountable tool box-supply cabinet and work bench assembly.

There is a continuing need for a tool chest with a work surface that is sturdy and unfolds with ease. Desirably, the work surface may be stowed for convenience in transport, and then easily assembled for use onsite.

SUMMARY

In concordance with the instant disclosure, a tool chest with a work surface that is sturdy and unfolds with ease, and which may be stowed for convenience in transport, and then easily assembled for use onsite, has been surprisingly discovered.

In one embodiment, the stowable work bench has a platform with a first sidewall and a second sidewall, and a work surface disposed between the first sidewall and the second sidewall. The platform is coupled to a first set of legs, which are connected to the first sidewall of the platform, and a second set of legs, which are connected to the second sidewall of the platform. The first set of legs are also attached to a first elongate base support, which is spaced apart from the platform and configured to be disposed within a tool chest. The second set of legs are attached to a second elongate base support, which is spaced apart from the platform and configured to be disposed within a tool chest. The first set of legs and the second set of legs are configured to collapse and expand, adjusting the distance between the platform and the elongate base supports in operation.

In another embodiment, the stowable work bench is disposed inside of a tool chest. The stowable work bench has a platform with a first sidewall and a second sidewall. A work surface is disposed between the first sidewall and the second sidewall. The platform is coupled to a first set of legs, which are connected to the first sidewall of the platform, and a second set of legs, which are connected to the second sidewall of the platform. The first set of legs are also attached to a first elongate base support, which is spaced apart from the platform and coupled to a ledge on an inner surface of the tool chest. The second set of legs are attached to a second elongate base support, which is spaced apart from the platform and coupled to the ledge on the inner surface of the tool chest. The first set of legs and the second set of legs are configured to collapse and expand, adjusting the distance between the platform and the elongate base supports in operation.

In a further embodiment, a stowable work bench has a platform with a first sidewall and a second sidewall, and a work surface disposed between the first sidewall and the second sidewall. Furthermore, the platform is coupled to a first set of legs, which are connected to the first sidewall of the platform, and a second set of legs, which are connected to the second sidewall of the platform. The first set of legs are also attached to a first elongate base support that is spaced apart from the platform. The second set of legs are attached to a second elongate base support that is spaced apart from the platform. To increase stability, the first set of legs are connected to the second set of legs by a plurality of cross members. The platform also contains hooks disposed on an underside of the platform, and which are configured to connect with a cross member to lock the platform in a predetermined position. The first set of legs and the second set of legs are configured to collapse and expand, adjusting the distance between the platform and the elongate base supports.

To assemble the stowable table, the platform is lifted until the first and second set of legs are raised diagonally relative to the first elongate base support and the second elongate base support. The first and second set of legs are then slid forward until sliding or rolling ends of the legs, disposed in channels of the first and second elongate member, abut stop blocks of the first elongate base support and the second elongate base support. Once the legs securely abut the stop block, the platform is pulled forward until the hooks lock with cross members that connect the first and second sets of legs. The platform, thereby position, is locked in place and ready for end use.

DESCRIPTION OF THE DRAWINGS

The above, as well as other advantages of the present invention, will become clear to those skilled in the art from the following detailed description of a preferred embodiment when considered in the light of the accompanying drawings in which.

DETAILED DESCRIPTION

The following detailed description and appended drawings describe and illustrate various exemplary embodiments according to the present disclosure. The description and drawings serve to enable one skilled in the art to make and use the invention and are not intended to limit the scope of the disclosure in any manner. In respect of the methods disclosed, the steps presented are exemplary in nature and, thus, the order of the steps is not necessary or critical unless otherwise disclosed.

In the description, relative terms such as "lower," "upper," "horizontal," "vertical," "forward," "rearward," "above," "below," "up," "down," "top," "diagonal," and "bottom" as well as derivative thereof (e.g., "horizontally," "downwardly," "upwardly," "diagonally," etc.) should be construed to refer to the orientation as then described or as shown in the related drawing. These relative terms are for convenience of description and do not require that the apparatus be constructed or operated in a particular orientation. Terms concerning attachments, such as "connected," "connecting," "coupled," and "coupling" are used interchangeably and refer to one structure or surface being secured to another structure or surface, unless expressly described otherwise.

FIGS. 1-12 show a stowable work bench 2 according to various embodiment of the present disclosure. The stowable work bench 2 is configured to be selectively disposed inside of a main body of a tool chest 3. The stowable work bench 2 may be provided separately, for disposable within a cavity of the main body of the tool chest 3, or may be provided together with the tool chest 3 in a stowed position ready for assembly, as desired.

Although the operation of the stowable work bench 2 is primarily described herein with respect to the tool chest 3, the present disclosure should not be read as limited to only tool chests 3. The term "tool chest" as used herein should be understood to include any container suitable for storage of tools and other work implements. As such, it should be understood that the stowable work bench 2 of the present disclosure may also be used in conjunction with a variety of similar containers, including totes, toolboxes, cases, and the like.

Figure 1:
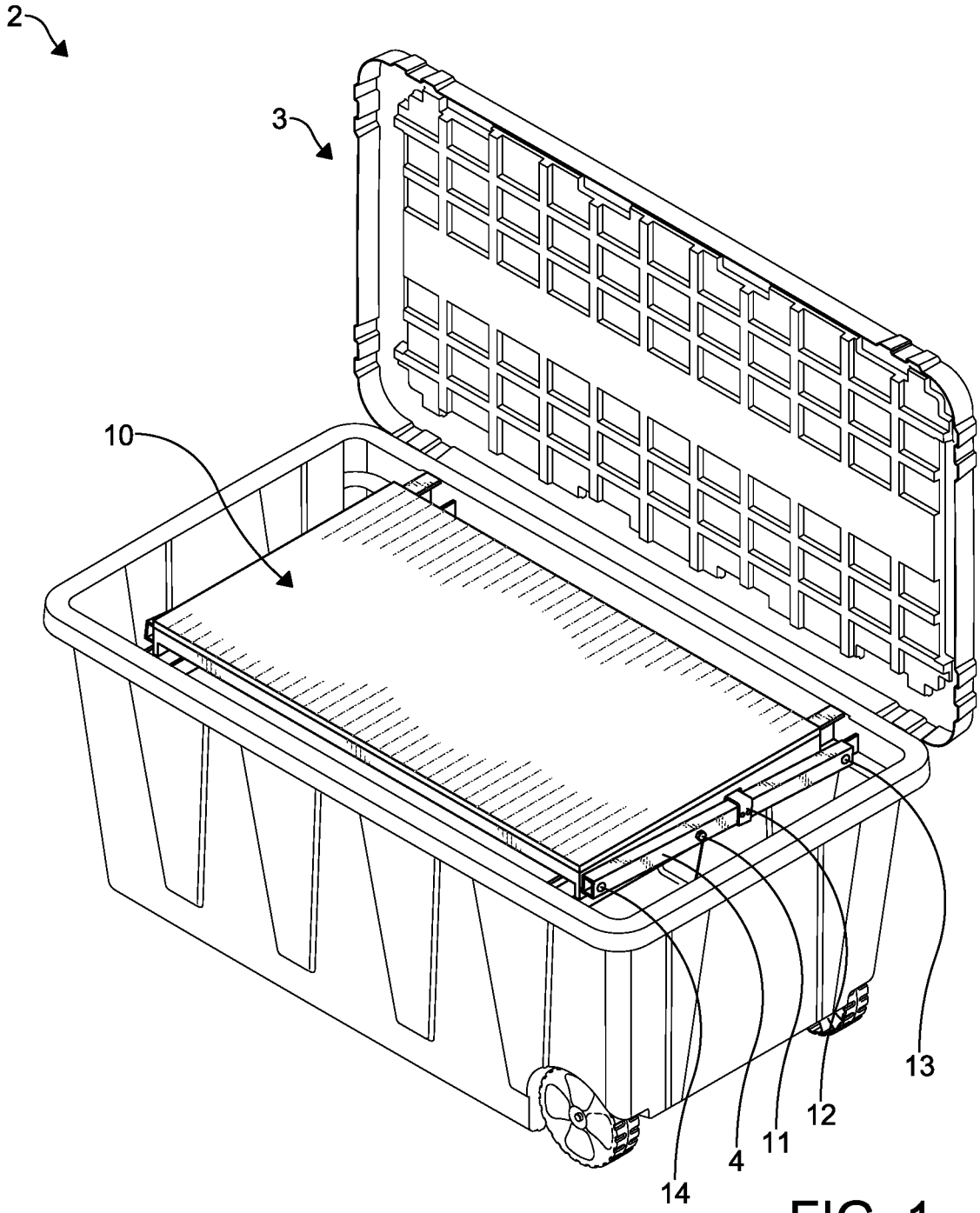
FIG. 1 is top perspective view of the stowable work bench in a first stage of assembly, collapsed within a tool chest with a lid of the tool chest opened to allow for the assembly of stowable work bench.
Figure 2:
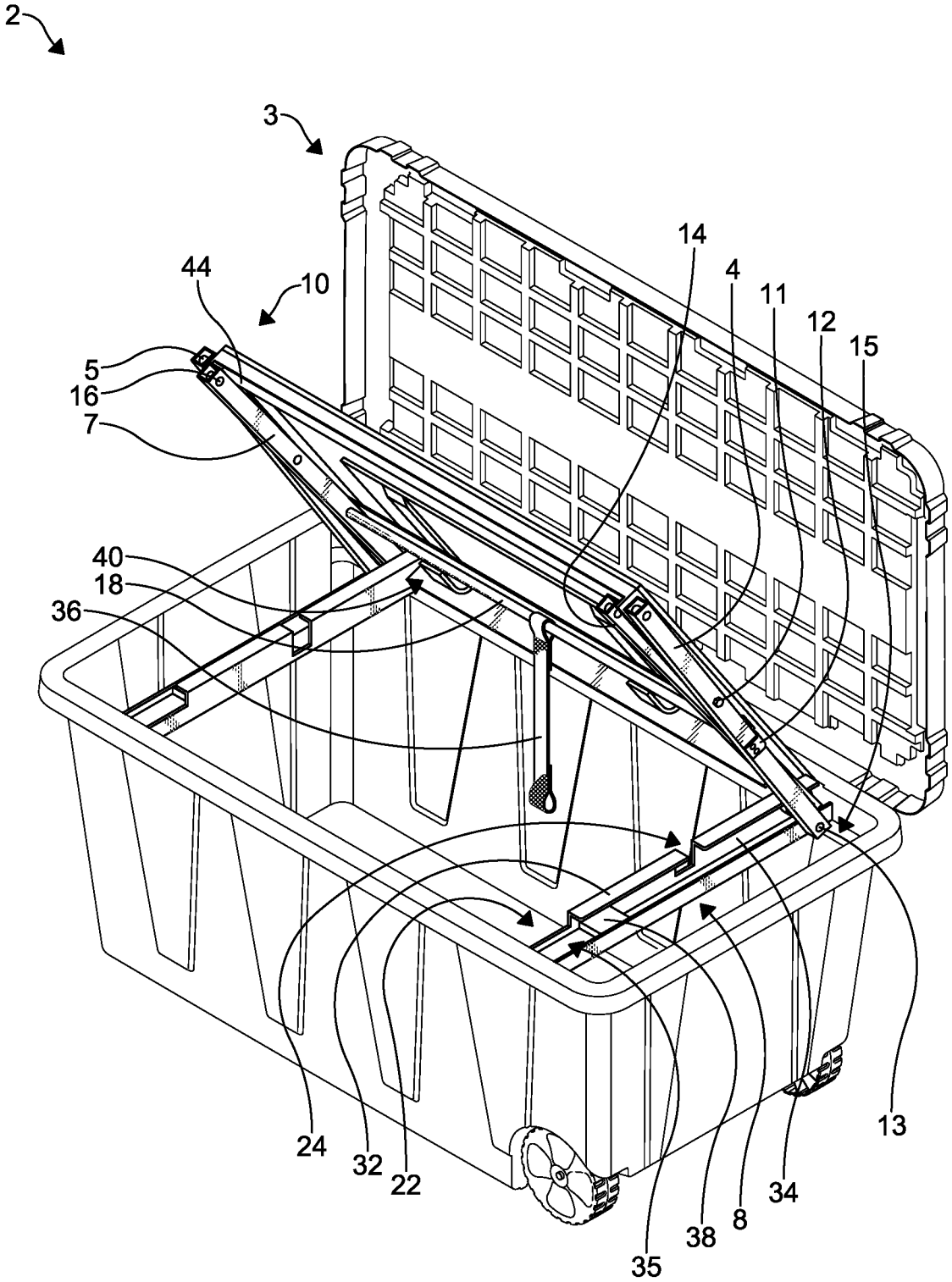
FIG. 2 is a top perspective view of the stowable work bench of FIG. 1, with the legs and platform lifted diagonally in a second stage of assembly.

As shown in FIG. 1, the stowable work bench 2 has a platform 10. The platform 10 has a first and second sidewalls 31, and a work surface disposed between the first sidewall 31 and the second sidewall 31. The platform 10 is connected to two elongate base supports 8. The elongate base supports 8 are spaced apart from one another in a generally parallel arrangement, and are disposed inside of the tool chest 3. In particular, the elongate base supports 8 may be disposed on an inner ledge 15 inside a cavity of the main body of the tool chest 3, for example, as shown in FIG. 2. The elongate base supports 8 may rest in place on the ledge, for example, by being placed in a molded recess configured to receive the supports 8, or may be affixed to the ledge 15 using mechanical fasteners such as screws, bolts or any other means chosen by a skilled artisan.

The ledge 15 on an inner surface of the tool chest 3 may have any suitable dimensions or placement within the tool chest 3 sufficient to support the elongate base supports 8. For example, the ledge 15 may wrap around the interior of the tool chest 3, or may be provided by a pair of ledges 15 disposed on opposing sides of the interior. Other suitable configurations and structure of the supporting ledge 15 of the tool chest 3 may also be used within the scope of the disclosure.

The elongate base supports 8 are attached to legs 4, 5, 6, 7. Each of the legs 4, 5, 6, 7 has a first end and a second end. A first set of the legs 4, 6, are coupled at the first ends thereof to a first sidewall 31 of the platform 10, and a second set of the legs 5, 7 are coupled at the first ends thereof to a second sidewall 31 of the platform. The legs 4, 5, 6, 7 further include first leg elements 4, 5, which are each rotatably coupled at the second end thereof to one of elongate base supports 8 at a connection point 13. The legs 4, 5, 6, 7 also include second leg elements 6, 7, which are each rotatably attached to a sliding roller 20 on the second end thereof.

Each of the sliding rollers 20 is disposed within one of the elongate base supports 8. For example, each of the elongate base supports 8 has a lip 32 that defines a channel 34, as shown in FIGS. 2-5 and 11-12. The roller 20 is disposed inside the channel 34 of both elongate base supports 8. The lip 32 militates against a removal of the roller 20 from the channel 34 in operation. The roller 20 may include a rotatable wheel attached to the second end of the second leg element 6, 7, for example. Other types of slidable or wheeled elements may also be secured to the second end of the second leg element 6, 7, as desired.

As shown in FIGS. 2-5, the second leg element 6 is rotatably attached at center connection point 11 to the first leg element 4. Likewise, the second leg element 7 is rotatably attached at a center connection point 11 to the first leg element 5. The center connection point 11 is a location generally disposed between the first and second ends of the first and second leg elements 4, 5, 6, 7. It should be appreciated that such a connection of the first and second leg elements 4, 5, 6, 7 forms a scissor joint, which allows the legs 4, 5, 6, 7 to selectively fold and unfold in operation.

With reference to FIGS. 2-3, 7, and 9-10, the first leg element 4 on one side of the platform 10 is connected to the first leg element 5 on the other side of the platform 10 by both a central cross member 12 and a top cross member 45. The top cross member 45 is connected to the first end of the first leg elements 4, 5 using a mechanical fastener, for example, screws, bolts or other suitable means, at point 14. The first leg elements 4, 5 are also connected to the central cross member 12 using a mechanical fastener, for example, screws, bolts, or other suitable means. The top cross member 45 is further disposed through an elongate slot 28 formed in the sidewalls 31 arranged on the opposite sides of the platform 10, which contributes to support and stability of the platform 10 while allowing the platform 10 to slide forward and rearward in operation.

The second leg element 6 one side of the platform 10 is attached to the second leg element 7 on the other side of the platform 10 by a central cross member 18 and a top cross member 44. The first ends of the second leg elements 6, 7 are connected to the top cross member 44 using mechanical fasteners, for example, screws, bolts or other suitable means, at or adjacent to point 16. For stability, the second leg element 6 on the one side of the platform 10 is also attached to second leg element 7 on the other side of the platform 10 through the central cross member 18, which is connected using a mechanical faster such as screws, bolts or the like at point 23.

Moreover, as shown in FIGS. 1-5 and 11, the elongate base supports 8 contain recesses 22, 24 configured to accommodate multiple cross members, thereby allowing the stowable work bench 2 to be completely disposed inside of the tool chest 3 when stowed. The recesses 22, 24 permit the platform 10 to fold flat, for example. In particular, the recess 24 may be configured to receive the central cross members 12, 18, while the recess 22 may configured to receive the top cross members 44, 45.

Additionally, the platform 10 has the sidewalls 31 that contain the recesses 26, 30, which are also configured to receive mechanical fasteners and cross members. The recess 26 is adapted to receive the mechanical fastener connecting the legs 4, 5, 6, 7 at the rotatable center connection point 11. It should be appreciated that the mechanical fastener between the first leg elements 4, 5, and the second leg elements 6, 7 at the connection point 11 may be exposed due to a spaced apart arrangement of the first leg elements 4, 5, relative to the second leg elements 6, 7, for example. The recess 30 is configured to receive the central cross members 12, 18, thereby enabling the stowable work bench 2 to lay flat when stowed within the tool chest 3. Other types of recesses accommodating different portions of the work bench 2 may also be provided to facilitate the foldability of the work bench 2, as desired.

Figure 3:
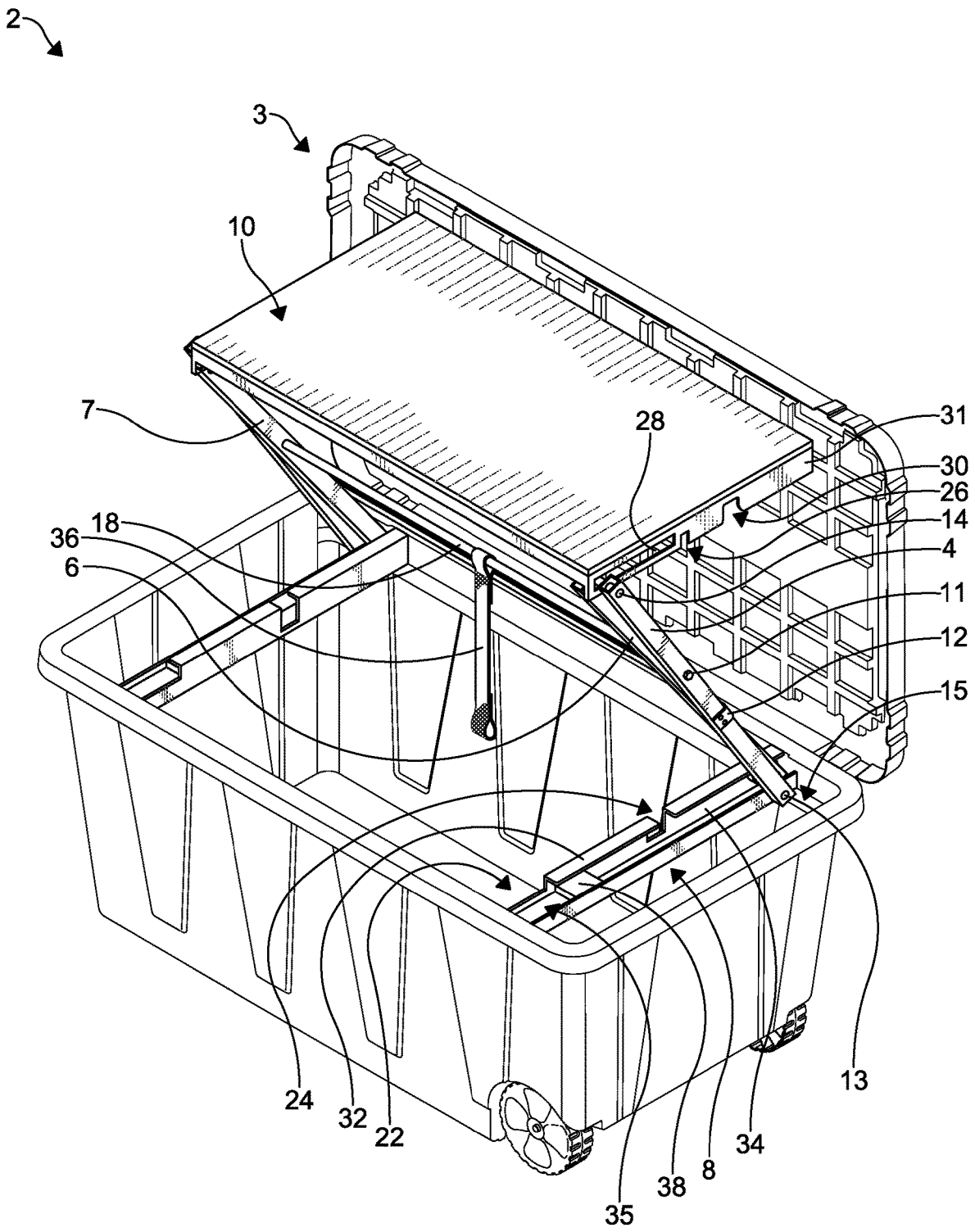
FIG. 3 is a top perspective view of the stowable work bench of FIG. 1, with the platform oriented horizontally and legs lifted diagonally in a third stage of assembly.
Figure 4:
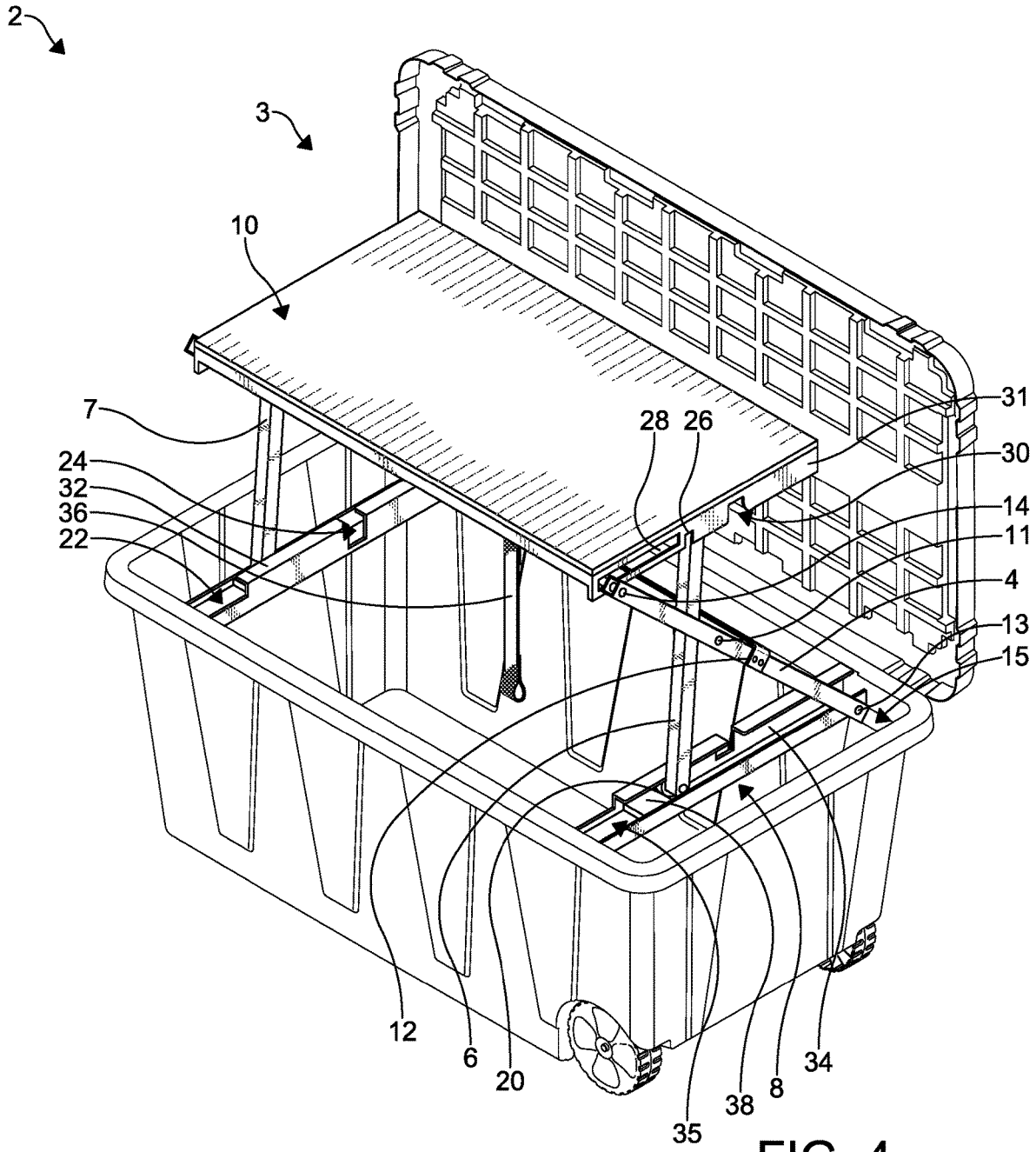
FIG. 4 is a top perspective view of the stowable work bench of FIG. 1, where the platform is oriented horizontally and the legs are separated in a fourth stage of assembly.
Figure 12:
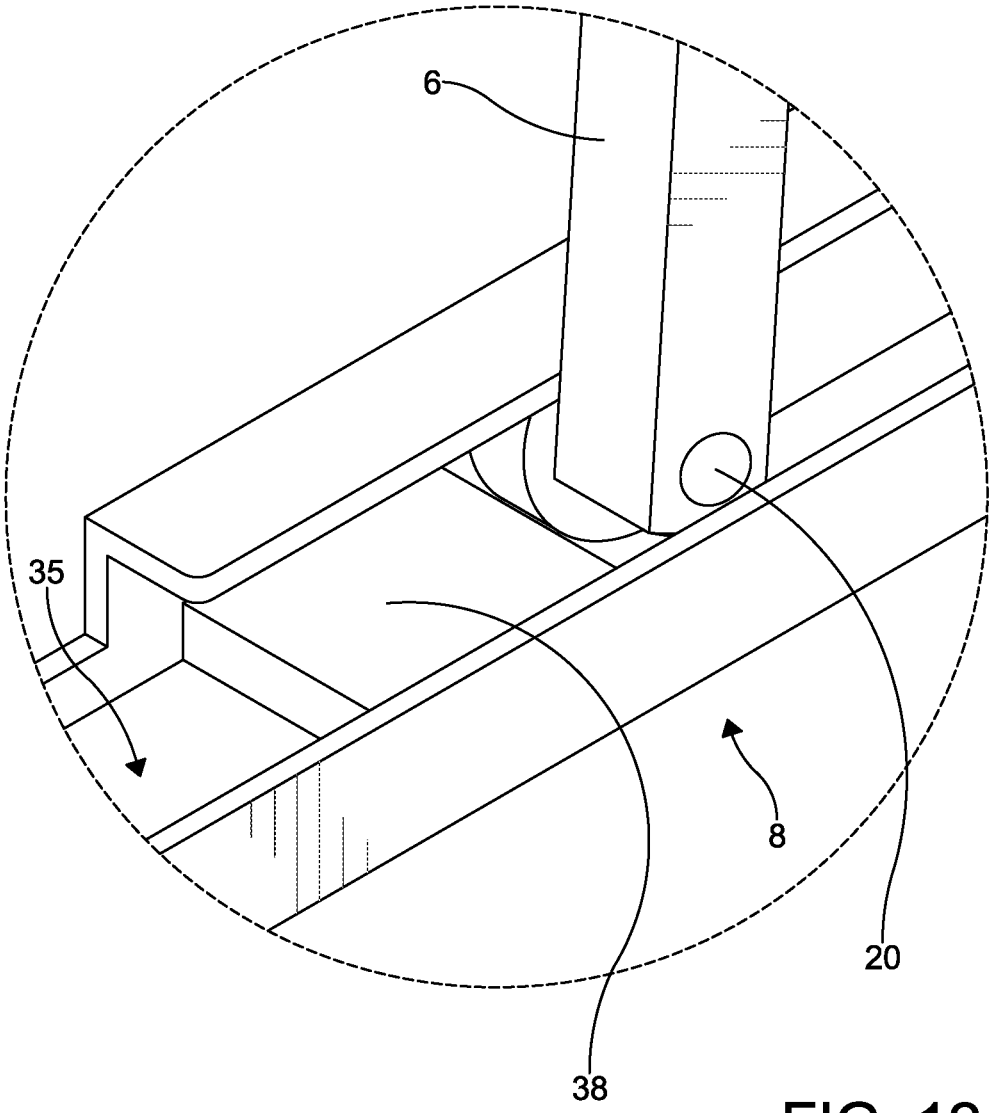
FIG. 12 is an enlarged fragmentary top perspective view taken at callout 12 in FIG. 11, depicting an elongate base support of the stowable work bench, and a roller at the end of a leg that is slidably disposed in the base support.

FIGS. 1-5 illustrate a stepwise unfolding of the stowable work bench 2 from a first position (FIG. 1), completely stowed, to a fifth position (FIG. 5), completely assembled. In operation, to unfold the stowable work bench 2, the platform 10 is initially raised backward, rotating the legs 4, 5, 6, 7 at connection point 13 until both the platform 10 and legs 4, 5, 6, 7 are oriented diagonal with the base supports 8, as shown in FIG. 2. The platform 10 is then lifted until the platform 10 itself is oriented substantially horizontal relative to the base supports 8, as shown in FIG. 3. While the platform 10 is horizontal, the second leg elements 6, 7 are then pulled forward, for example, by using a strap handle 36 depending from the central cross member 18. By pulling on the strap handle 36, the rollers 20 are pulled forward in the base members 8 until the rollers 20 abut stop blocks 38, as shown in FIGS. 4 and 12.

With respect to the movement of the legs 4, 5, 6, 7 from the third position shown in FIG. 3 to the fourth position shown in FIG. 4, it should be understood that the top cross member 44 is attached to second leg elements 6, 7, while the top cross member 45 is attached to first leg elements 4, 5. When the first end of the second leg elements 6, 7 is moved in a rearward direction, it causally moves the second end, which is slidably disposed in the elongate base support 8, by way of the scissor joint in a forward direction. The movement of the roller 20 in the forward direction also moves the top cross member 44 that is attached to the first end of second leg elements 6, 7, in the rearward direction. Additionally, moving the roller 20 forward causes the top cross member 45, which is attached to first leg elements 4, 5, to move in the same direction. The top cross member 45 is disposed in the elongate slot 28 of the platform 10 and constrained in movement by the elongate slot 28. Consequentially, moving the roller 20 forward moves the top cross member 45 forward and the top cross member 44 backward, thereby creating two parallel top cross members 44, 45 to support the platform 10, as shown in FIGS. 4 and 9.

Figure 11:
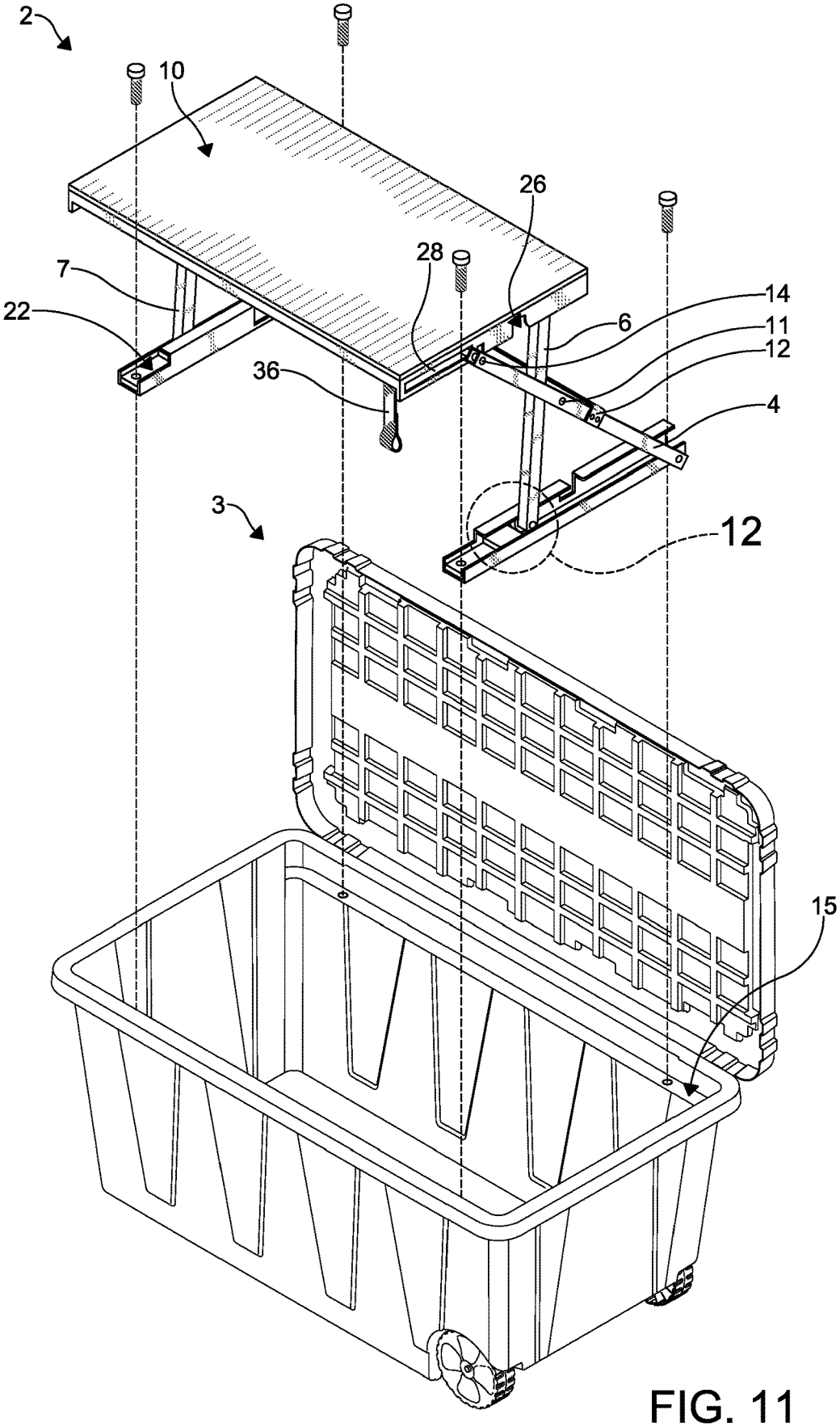
FIG. 11 is an exploded top perspective view of the stowable work bench of FIG. 5.

It should be appreciated that the stop block 38 is spaced apart from a terminating edge of each of the elongate base supports 8. A gap 35 defined by this spaced apart arrangement of the stop block 38 further allows the elongate base support 8 to be affixed to the ledge 15 without interference, for example, by the use of mechanical fasteners such as screws, bolts, or the like disposed through holes in base members 8 at the gap 35, as shown in FIG. 11.

Figure 5:
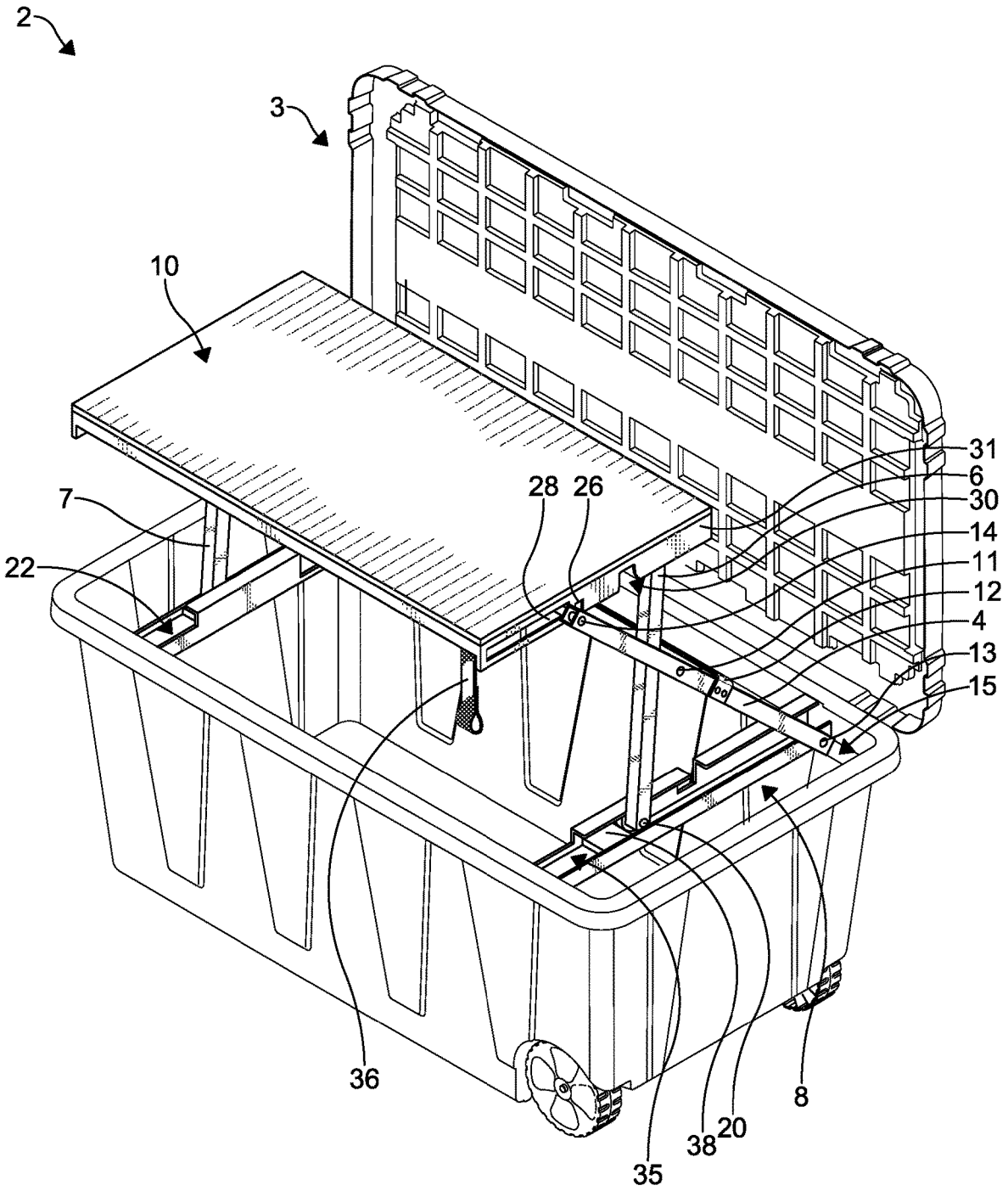
FIG. 5 is a top perspective view of the stowable work bench of FIG. 1, with the platform slid forward to lock it into place in a fifth and final stage of assembly.
Figure 6:
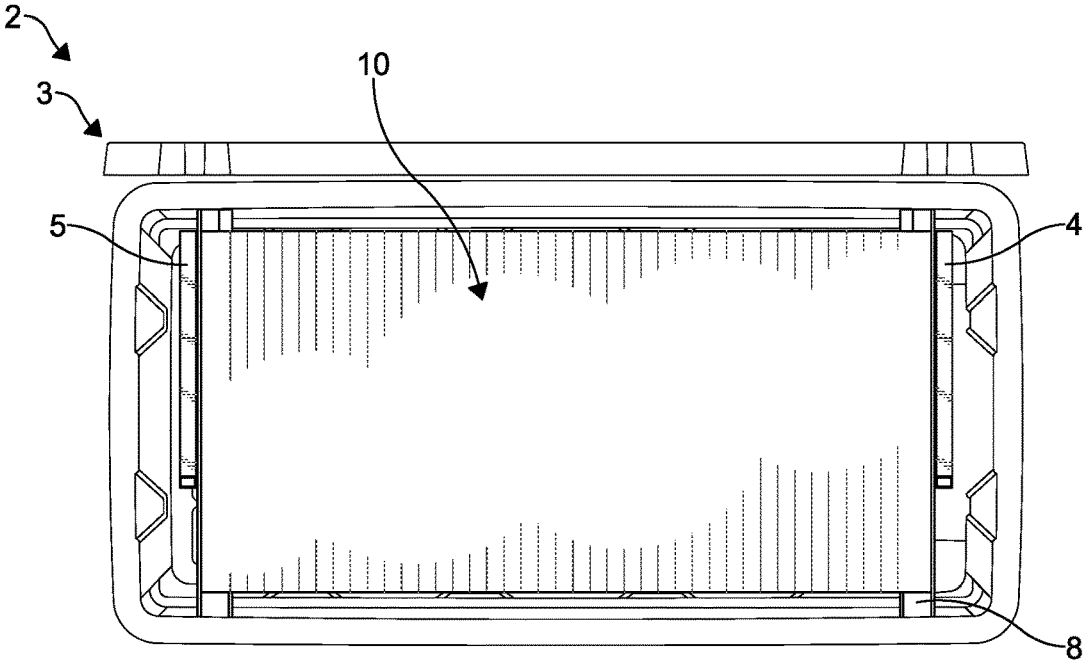
FIG. 6 is a top plan view of the stowable work bench in the final stage of assembly as shown in FIG. 5.
Figure 7:
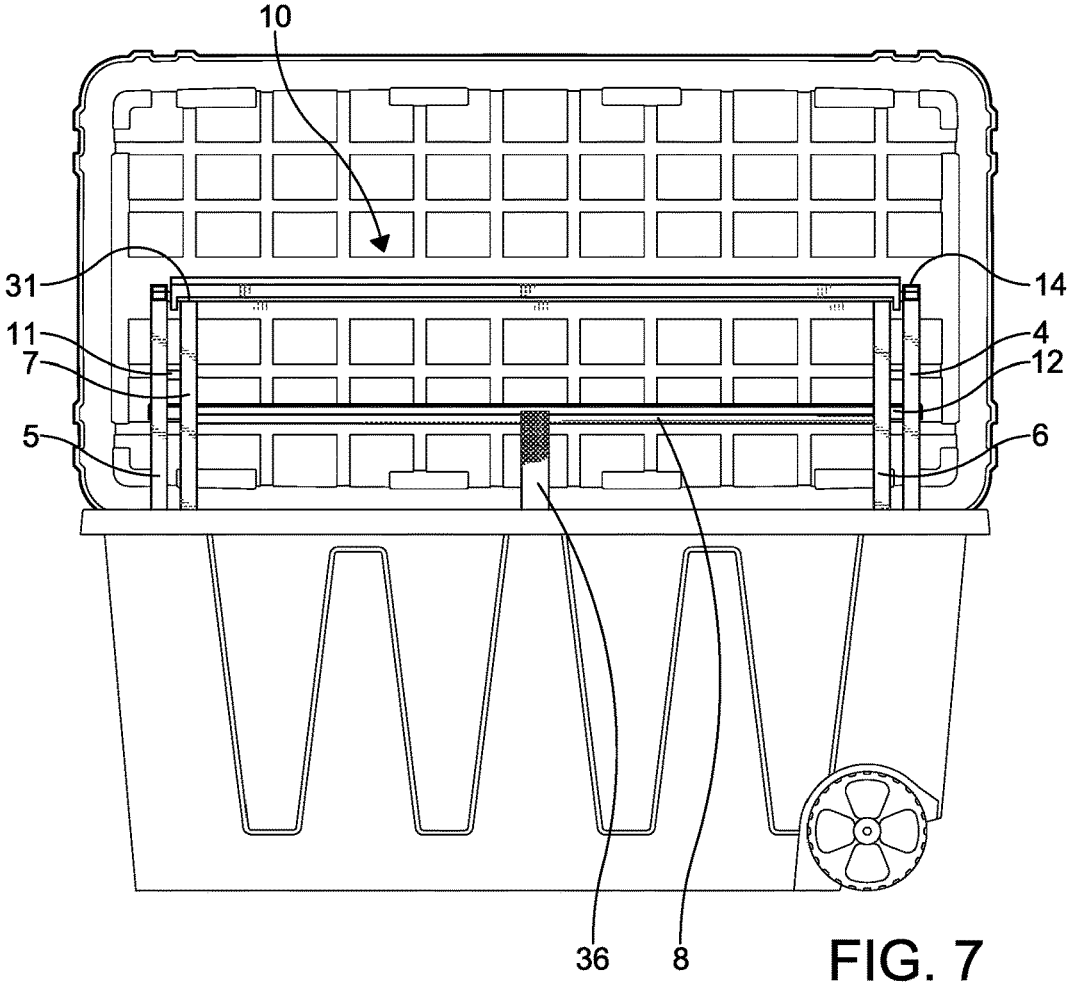
FIG. 7 is a front elevational view of the stowable work bench shown in FIG. 6.
Figure 8:
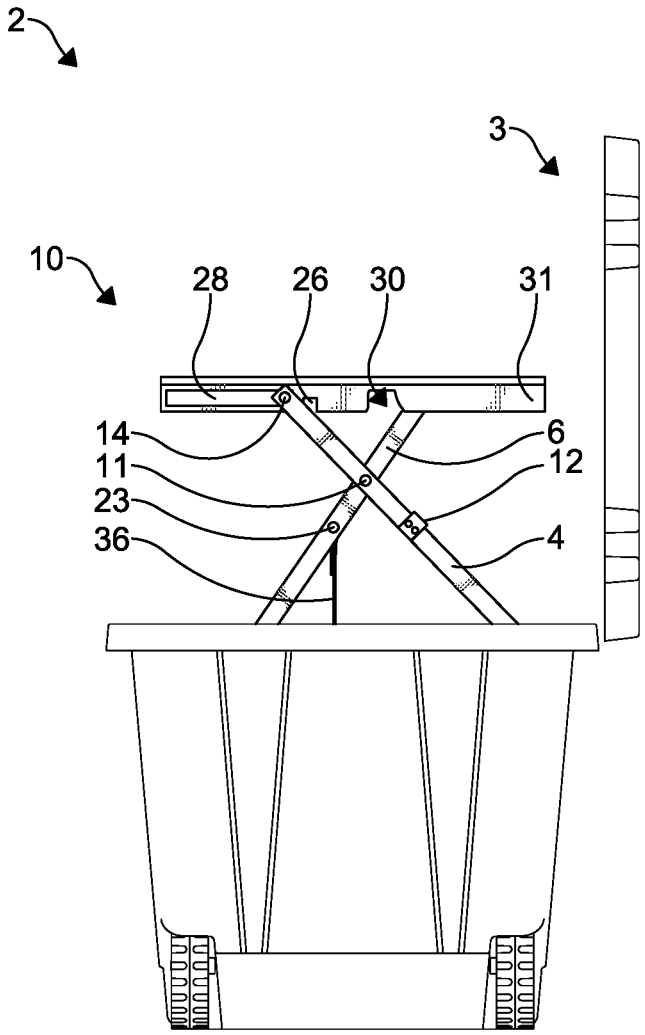
FIG. 8 is a side elevational view of the stowable work bench shown in FIGS. 6 and 7.
Figure 9:
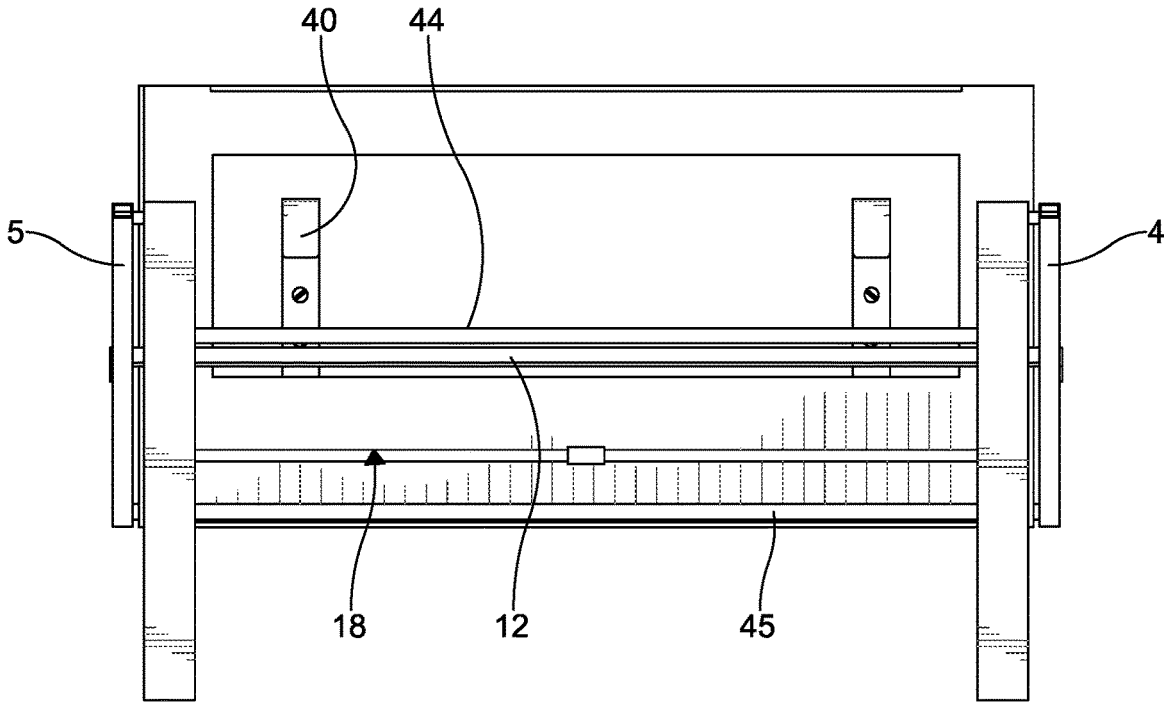
FIG. 9 is a bottom plan view of the stowable work bench in the third stage of assembly as shown in FIG. 4, where the stowable work bench is not yet locked into position.
Figure 10:
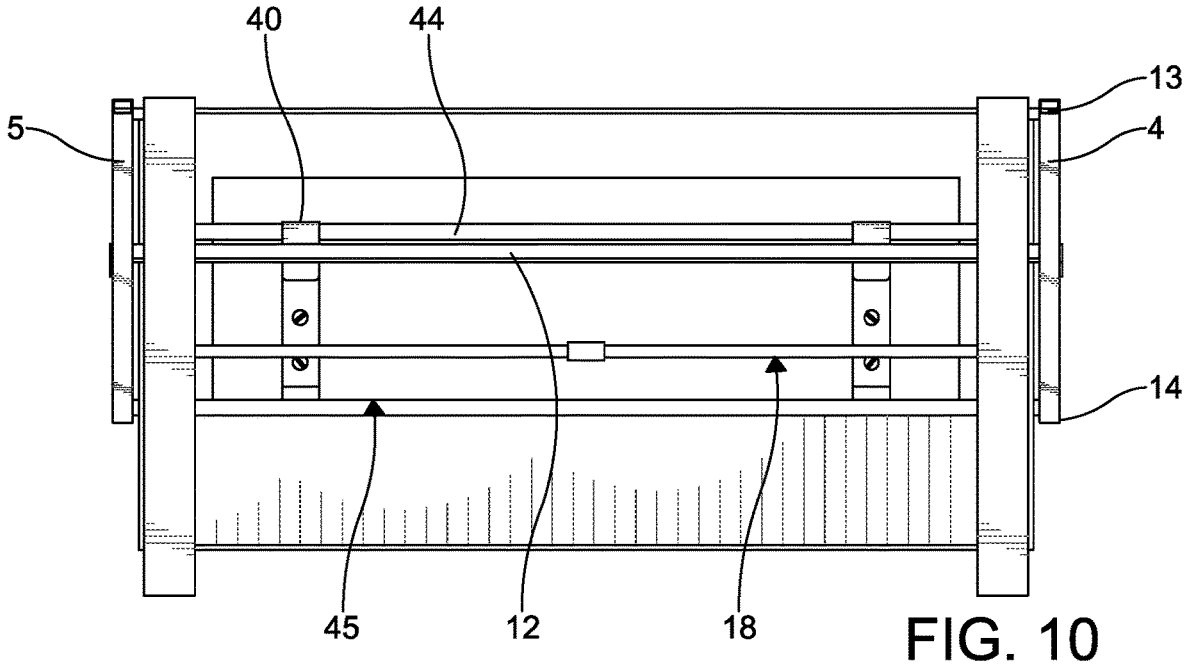
FIG. 10 is a bottom plan view of the stowable work bench in the fourth stage of assembly as shown in FIG. 5, showing the hooks interlocking with a cross member to lock the stowable work bench in position.

As shown in FIGS. 5 and 9-10, the platform 10 is rested on the top cross members 44, 45 and then slid forward to a fifth position, engaging hooks 40 disposed on an underside of the platform 10 with the top cross member 44. The platform 10 is thereby locked securely in place, as shown in FIGS. 5 and 10, and ready for use.

When the work bench 2 is to be stowed, the order of steps described hereinabove with respect to FIGS. 1-5 is reversed. For example, a user pushes the platform 10 backwards, uncoupling the top cross member 44 from the hooks 40, as shown in FIGS. 4 and 9. The platform 10 is then folded upward, which in turn moves the roller 20 and second leg elements 6, 7 rearward. Once the second leg elements 6, 7 are moved adjacent to connection point 13, the platform 10 can be lowered into the tool chest 3 and stowed for transport or storage.

FIGS. 9-10 illustrate a bottom perspective of the stowable work bench 2, depicted without the tool chest 3 to fully expose the underlying structure of the stowable work bench 2. FIG. 9 shows the stowable work bench 2 in the fourth position, with the top cross member 44 in the furthest position away from the hooks 40. FIG. 10 illustrates the stowable work bench 2 in the fifth and final position, with platform 10 slid forward and the top cross member 44 coupled to the hooks 40.

FIG. 11 illustrates an exploded view of the stowable work bench 2 away from the tool chest 3. The stowable work bench 2 is connected to the tool chest 3 using four screws that attach the stowable work bench 2 to the ledge 15. The leader lines showing where the screws attach the stowable work bench 2 to the ledge 15.

FIG. 12 is an enlarged view of the stowable work bench 2, which displays the roller 20 slidably disposed inside the channel 34 of the elongate base support 8 in either the fourth position or the fifth position of assembly. The roller 20 is also abutting the stop block 38. The elongate base support 8 is attached to the ledge 15 at the gap 35 using a mechanical fastener such as screws, bolts or other suitable means chosen by a skilled artisan.

Advantageously, the stowable work bench 2 of the present disclosure allows to the tool chest 3 to be provided with a work surface that is sturdy and unfolds with ease. The stowable work bench 2 may further be stowed for convenience in transport, and then easily assembled for use when onsite, as described hereinabove.

While certain representative embodiments and details have been shown for purposes of illustrating the present invention, it will be apparent to those skilled in the art that various changes may be made without departing from the scope of the disclosure, which is further described in the following appended claims.

The invention claimed is:

1. A stowable work bench for a tool chest, comprising:

a platform having a first sidewall and a second sidewall, and a work surface disposed between the first sidewall and the second sidewall;

a first set of legs connected to the first sidewall of the platform;

a second set of legs connected to the second sidewall of the platform;

a first elongate base support spaced apart from the platform and attached to the first set of legs, the first elongate base support configured to be attached to the tool chest; and a second elongate base support spaced apart from the platform and attached to the second set of legs, the second elongate base support configured to be attached to the tool chest, the first set of legs and the second set of legs configured to selectively collapse and expand to adjust a distance between the platform and the first elongate base support, and the platform and the second elongate base support, each of the first set of legs and the second set of legs includes a first leg element and a second leg element and each of the first leg element and the second leg element has a first end and a second end with a central area disposed between the first end and the second end, the first set of legs are connected to the second set of legs by a first top cross member disposed on the first end of the first leg element of the first set of legs and the first end of the first leg element of the second set of legs, the first set of legs are further connected to the second set of legs by a second top cross member disposed on the first end of the second leg element of the first set of legs and the first end of the second leg element of the second set of legs, the first set of legs are also connected to the second set of legs by a first central cross member disposed on the central area of the second leg element of the first set of legs and the central area of the second leg element of the second set of legs, the first central cross member further comprising a strap handle for a user to pull while assembling the stowable workbench, the first set of legs are additionally connected to the second set of legs by a second central cross member disposed on the central area of the first leg element of the first set of legs and the central area of the first leg element of the second set of legs, and the first leg element and the second leg element of the each of the first set of legs and the second set of legs are rotatably coupled with a mechanical fastener, whereby a scissoring action of the first leg element and the second leg element is permitted.

2. The stowable work bench of claim 1, wherein the first end of the first leg element is slidably coupled to the first top cross member through an elongate slot formed in the first sidewall of the platform, and the second end of the first leg element is rotatably coupled to the first elongate base support.

3. The stowable work bench of claim 1, wherein each of the first elongate base support and second elongate base support contain a channel.

4. The stowable work bench of claim 3, wherein the first end of the second leg element is coupled to the second top cross member, and the second end of the second leg element is coupled to a roller.

5. The stowable work bench of claim 4, wherein the roller is disposed in the channel of the first elongate base support.

6. The stowable work bench of claim 1, wherein the first sidewall and the second sidewall each have an elongate slot formed therein, and the first top cross member is disposed through the elongate slot of the first sidewall and the elongate slot of the second sidewall, which allows the platform to slide forward and rearward in operation.

7. The stowable work bench of claim 1, wherein the platform contains a recess in both the first sidewall and the second sidewall configured to receive the first central cross member when the platform is stowed.

8. The stowable work bench of claim 7, wherein the first elongate base support and second elongate base support each contain a recess configured to receive the first central cross member when the platform is stowed.

9. The stowable work bench of claim 1, wherein the platform has hooks disposed on an underside of the platform, the hooks configured to cooperate with the second top cross member to lock the platform into position.

10. The stowable work bench of claim 1, wherein each of the first elongate base support and the second elongate base support has a stop block configured to militate against an expanding of the first set of legs and the second set of legs beyond a predetermined location.

11. A tool chest with a stowable work bench, comprising:

a main body having a cavity within which the stowable work bench is disposed, the stowable work bench including a platform having a first sidewall and a second sidewall, and a work surface disposed between the first sidewall and the second sidewall;

a first set of legs connected to the first sidewall of the platform;

a second set of legs connected to the second sidewall of the platform;

a first elongate base support spaced apart from the platform and attached to the first set of legs, the first elongate base support attached to the tool chest; and a second elongate base support spaced apart from the platform and attached to the second set of legs, the second elongate base support attached to the tool chest, the first set of legs and the second set of legs configured to selectively collapse and expand to adjust a distance between the platform and the first elongate base support, and the platform and the second elongate base support, each of the first set of legs and the second set of legs includes a first leg element and a second leg element and each of the first leg element and the second leg element has a first end and a second end with a central area disposed between the first end and the second end, the first set of legs are connected to the second set of legs by a first top cross member disposed on the first end of the first leg element of the first set of legs and the first end of the first leg element of the second set of legs, the first set of legs are further connected to the second set of legs by a second top cross member disposed on the first end of the second leg element of the first set of legs and the first end of the second leg element of the second set of legs, the first set of legs are also connected to the second set of legs by a first central cross member disposed on the central area of the second leg element of the first set of legs and the central area of the second leg element of the second set of legs, the first central cross member further comprising a strap handle for a user to pull while assembling the stowable workbench, the first set of legs are additionally connected to the second set of legs by a second central cross member disposed on the central area of the first leg element of the first set of legs and the central area of the first leg element of the second set of legs, and the first leg element and the second leg element of the each of the first set of legs and the second set of legs are rotatably coupled with a mechanical fastener, whereby a scissoring action of the first leg element and the second leg element is permitted.

12. The tool chest of claim 11, wherein the main body has an inner ledge, and the first elongate base support and the second elongate base support disposed on the inner ledge.

13. The tool chest of claim 12, wherein the first elongate base support and the second elongate base support are affixed to the inner ledge with mechanical fasteners.

* * * * *